United States Patent [19]

Varga

[11] 4,253,298

[45] Mar. 3, 1981

[54] HIGH SPEED CAGE FLY-OFF STRANDER

[75] Inventor: Joseph Varga, Toronto, Canada

[73] Assignee: Ceeco Machinery Manufacturing Limited, Concord, Canada

[21] Appl. No.: 10,007

[22] Filed: Feb. 7, 1979

[51] Int. Cl.[3] ..... D07B 3/04

[52] U.S. Cl. ..... 57/13; 57/15; 57/266; 57/268

[58] Field of Search ..... 57/3, 6, 13–15, 57/266, 268, 270

[56] References Cited

U.S. PATENT DOCUMENTS

| | | | |
|---|---|---|---|
| 824,171 | 6/1906 | Champlin | 57/13 X |
| 1,024,196 | 4/1912 | Gough et al. | 57/13 |
| 2,833,110 | 5/1958 | Fredriksson et al. | 57/14 |
| 3,429,115 | 2/1969 | Purdy et al. | 57/266 |
| 3,448,569 | 6/1969 | Brown et al. | 57/15 |
| 3,563,020 | 2/1971 | Harris et al. | 57/266 |
| 3,827,225 | 8/1974 | Schoerner | 57/13 |
| 3,902,307 | 9/1975 | Schoerner | 57/13 |
| 3,955,348 | 5/1976 | Orlandi | 57/13 |
| 4,015,415 | 4/1977 | Otsuki et al. | 57/13 X |
| 4,098,063 | 7/1978 | Varga | 57/13 |

FOREIGN PATENT DOCUMENTS

| | | |
|---|---|---|
| 2248945 | 4/1974 | Fed. Rep. of Germany . |
| 319632 | 9/1929 | United Kingdom . |
| 1269717 | 4/1972 | United Kingdom . |

*Primary Examiner*—John Petrakes

*Attorney, Agent, or Firm*—Lackenbach, Lilling & Siegel

[57] ABSTRACT

A high speed rigid strander is described that has a rotatably mounted cage which includes a plurality of bobbin support members which are parallel to and angularly spaced about the axis of rotation of the cage. Each support member includes a locking mechanism for simultaneously locking or releasing an entire row of bobbins, each of which is spaced from the axis of rotation and has its longitudinal axis oriented generally radially or at an angle normal to the strander axis. Wire guides associated with each bobbin fly the wires off the bobbins under the action of external pulling forces without requiring the bobbins to rotate. Fly-off is generally radially inwardly against the action of centrifugal forces and the wires are guided towards the strander axis and then parallel thereto so that the wires from all of the bobbins can be brought to an end of the rotating cage and wound about a core wire. Also described is a loading and unloading system which can advantageously be used with the stranders of the present invention.

20 Claims, 11 Drawing Figures

FIG. 6
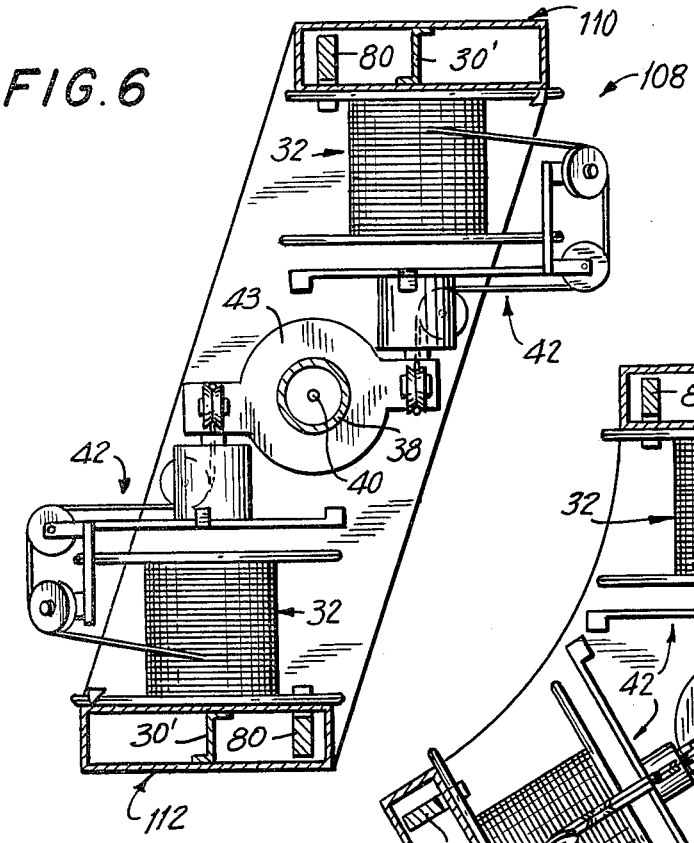
FIG. 7
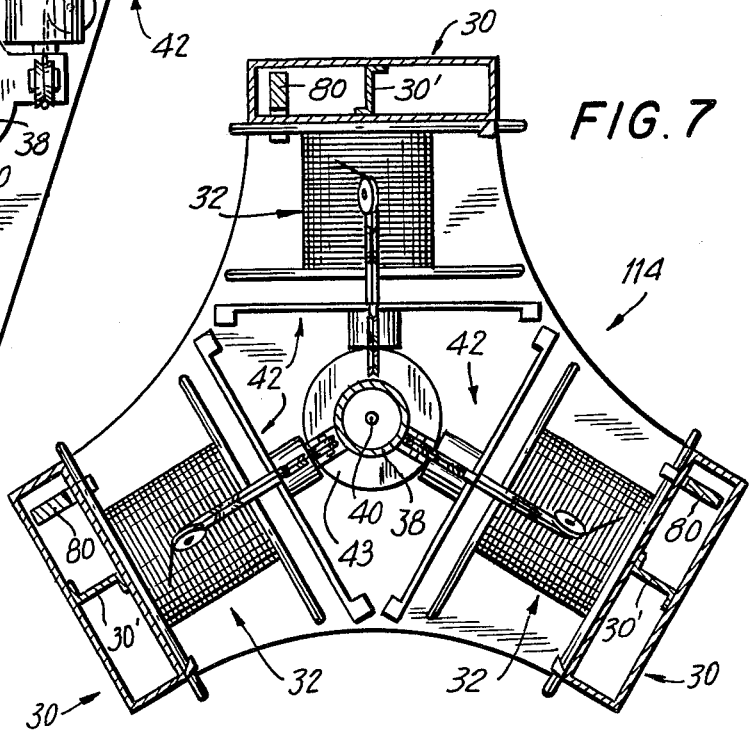
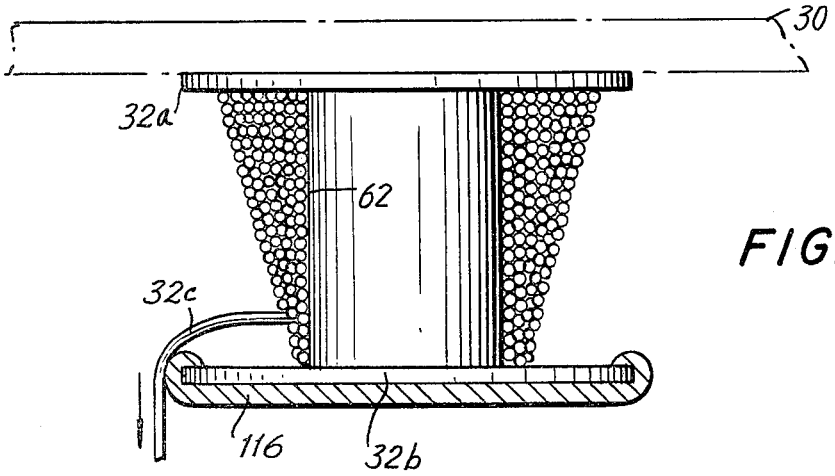
FIG. 8

HIGH SPEED CAGE FLY-OFF STRANDER

BACKGROUND OF THE INVENTION

The present invention generally relates to high speed cable or wire stranders, and more specifically to a high speed rigid-type cage strander in which the axes of the bobbins are oriented at angles substantially normal to the axis of rotation of the strander and wire take-off takes place without bobbin rotation.

When manufacturing a cable from a plurality of wires, a core wire formed by either a single wire or a plurality of already stranded wires is usually passed through the machine and other wires are wrapped around the core wire either while the core wires move along its path or at the end of the machine. This function is usually carried out by high speed machines which, as a rule, include one or more rotatable frames or housings and a plurality of wire-carrying bobbins located within the frame or carried by supports mounted on the frames.

The core wire is usually paid-off from a bobbin mounted outside the frame and passed through the frame through a path either along the axis of rotation of the frame or displaced from the axis of rotation of the frame. The way the core wire is handled characterizes the type of wire strander and its application.

If the core wire is passed through the machine along its axis of rotation, the wire carrying bobbins rotate around it and the wires paid-off are wound on the core wire at several points along the machine. This system allows the manufacture of conductors with a high number of wires and a change in direction of the various layers since the machine is composed of many cage sections independent of each other. Futhermore, since the core wire passes substantially along the axis of the machine, a large multi-stranded core can be used.

If the core wire is passed through the machine along a path significantly displaced from the axis of rotation of the frame, the wire carrying bobbins are positioned inside the frame along its axis of rotation and they remain stationary while the frame rotates. The cable wires are paid-off from the bobbins and the wires pass through a path displaced from the axis of rotation of the machine and are wound around the core wire at the end of the machine. This method allows the manufacture of conductors with a relatively low number of wires and the various layers of the stranded conductors must be wound in the same direction.

In the past, wire carrying bobbins mounted on the frame of the strander have usually been mounted so that the bobbins were required to rotate along their longitudinal axis in order to pay-off the wire. This arrangement usually requires some control of the rotation of the bobbins, such as a brake mechanism for each bobbin to provide the required wire tension and to assure that the bobbins will not continue to rotate when the frame of the strander has stopped its rotation.

The braking device causes the tension of the wire paid-off from the bobbins to vary during the operation of the strander since the wire pulling tension required to make the bobbin rotate is different when the bobbin is full or near empty. If the initial braking force is adjusted for a full bobbin, the same braking force applied to a bobbin with partially depleted wire supply is sometimes sufficient to cause unacceptable stretch, especially for wires of the smaller gauge. In such a case, the cable produced will be malformed. Also, since the braking force is applied to each bobbin before the initial start of the strander, there is a tendency to stretch the wire before the strander reaches its normal operational speed. Because of frequent malfunction of the brakes, the wires from the bobbins within the frame of the strander occasionally continue to pay-out after the strander has been stopped, and because different brake forces are applied to different bobbins, different tensions are created in the wire paid-out from the bobbins. Therefore, many times the cable formed by traditional stranders have one or more wires loosely wrapped with the remaining wire more tightly wrapped.

Most known stranders being used in the manufacture of stranded cable from a plurality of wires have additional disadvantages. Unloading of empty bobbins and loading of full bobbins is normally a time consuming process and can result in a substantial down time of the machine. In some instances, bobbins must be handled individually during loading and unloading. At best, the prior art teaches the simultaneous loading and unloading of a single row of bobbins. For example, for a twenty-four bobbin rotor, it may take almost one half an hour to load and unload even with the most advanced machines.

Safety has always been a concern with respect to stranding machines since they normally rotate at high speeds and carry very heavy bobbins. Failure of a machine which causes accidental release of a bobbin during operation can result in substantial personal injury and property damage. While numerous approaches have been proposed to minimize such accidents, many machines are still not sufficiently safe.

SUMMARY OF THE INVENTION

Accordingly, in order to overcome the above-described disadvantages inherent in the prior art stranding machines, as well as achieve other objects which will become evident from the descriptions that follow, a strander in accordance with the present invention comprises a longitudinal shaft defining the machine axis of the strander and adapted to advance a core wire along the length thereof. A support portion is spaced from and generally parallel to said shaft and mounted for rotation about said axis. Securing means are provided on said support portion for securing at least one wire-carrying bobbin to said support portion in a position displaced from said shaft and with the longitudinal axis of said at least one bobbin oriented generally radially at an angle substantially normal with respect to said shaft. Wire payoff means are provided for guiding the wire paid off from said at least one bobbin in a generally radially inward direction around the radially innermost end of the bobbin. The wire is then guided to a point proximate to said shaft which is substantially coincident with the longitudinal axis of said at least one bobbin and, subsequently, the wire is guided in a direction generally parallel to said shaft. Fly-off takes place under the action of external pulling forces acting on the wires, thus enabling the wires which are paid off the bobbins to be brought to an end of said shaft and wound about the core wire.

The high speed cage fly-off strander of the present invention is extremely safe in operation because the bobbins, during rotation of the cage, are urged by centrifugal forces into pressure abutment against the support portion which can be a reinforced beam or support member. There are no locking elements which can be inadvertently released during operation of the strander. In fact, the higher the rotational speed of the rotating cage, the more secure the bobbins are against the support portion because of the increased frictional forces developed therebetween.

In addition to providing a better quality strand with greater safety, the fly-off strander of the present invention substantially facilitates loading and unloading of the strander and substantially reduces the times required therefor. The strander includes means for simultaneously locking or releasing one or two rows of bobbins simultaneously so that said rows can be lifted out of the strander and a new set of bobbins inserted thereinto. For example, in a presently preferred embodiment wherein four rows of bobbins are angularly displaced by 90° about the axis of rotation of the strander, diametrically opposite rows of bobbins can be simultaneously removed or inserted to thereby permit loading or unloading of the entire strander in two steps. An additional advantage obtained by removing diametrically opposite sets or rows of bobbins simultaneously is that the rotating frame of the strander is always balanced before and after the removal or insertion of two rows of bobbins. Being balanced, the rotating frame or cage of the strander can be rotated to the desired loading and unloading positions with a low-torque indexing device. This further reduces the complexity and the cost of the stranding machine.

Other advantageous features of the invention include the fact that the disclosed cage strander can be designed for higher speeds than conventional rigid-type stranders and can accept bigger packages. These factors significantly increase the productivity of the subject strander. Also, the ability of the present strander to take off wire from stationary bobbins with much lower and more uniform tensions also enables the strander to reliably work with fine gage or low tensile wires with minimum breakage.

BRIEF DESCRIPTION OF THE DRAWINGS

Other features and advantages of the present invention will become more apparent from a reading of the following specification, when taken in conjunction with the accompanying drawings, in which:

FIG. 6 is an end view of another embodiment of the strander in accordance with the invention, taken in section, and showing the supporting frame members offset from the axis of rotation of the strander to permit the strander to be made more compact with attendant decreases in centrifugal forces acting on the bobbins and the take-off guide;

FIG. 7 is an end elevational view of still another embodiment of the present invention, taken in section, and illustrating a frame or cage adapted to support bobbins at angular orientations spaced from each other 120°;

FIG. 8 illustrates the manner in which a bobbin may be wound when used in conjunction with the stranders of the present invention, illustrating the manner in which the bobbin abuts a frame support member at one of its flanges and is provided at the opposite flange with an optional smooth ring which contacts the advancing wire during fly-off without damage to the wire.

DESCRIPTION OF THE PREFERRED EMBODIMENT

Figure 1:
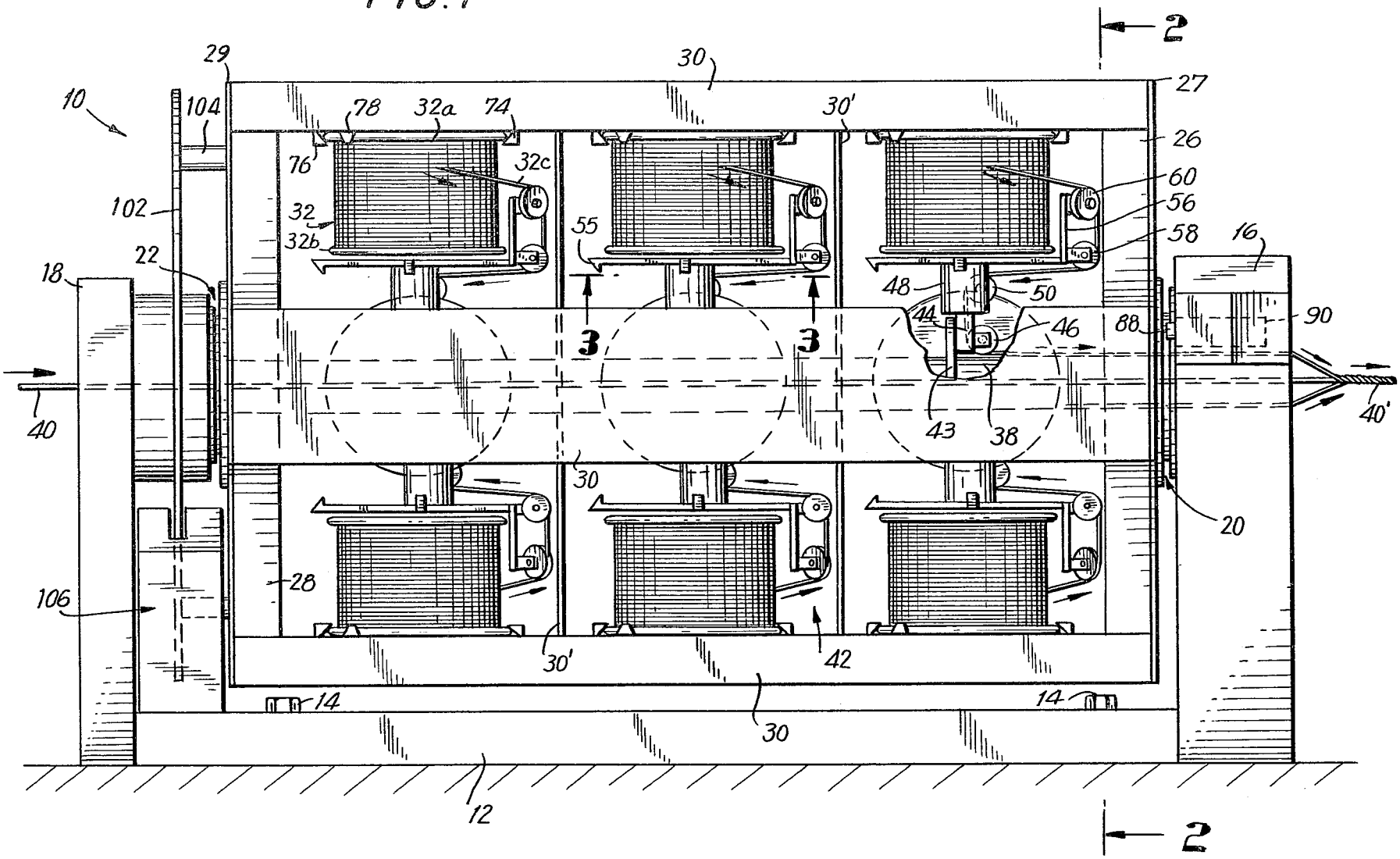
FIG. 1 is a side elevational view of the high-speed cage fly-off strander in accordance with the present invention, shown partially broken away to expose the balanced fly-off or take-off arm or guide and the manner in which it is mounted on the shaft of the strander.
Figure 2:
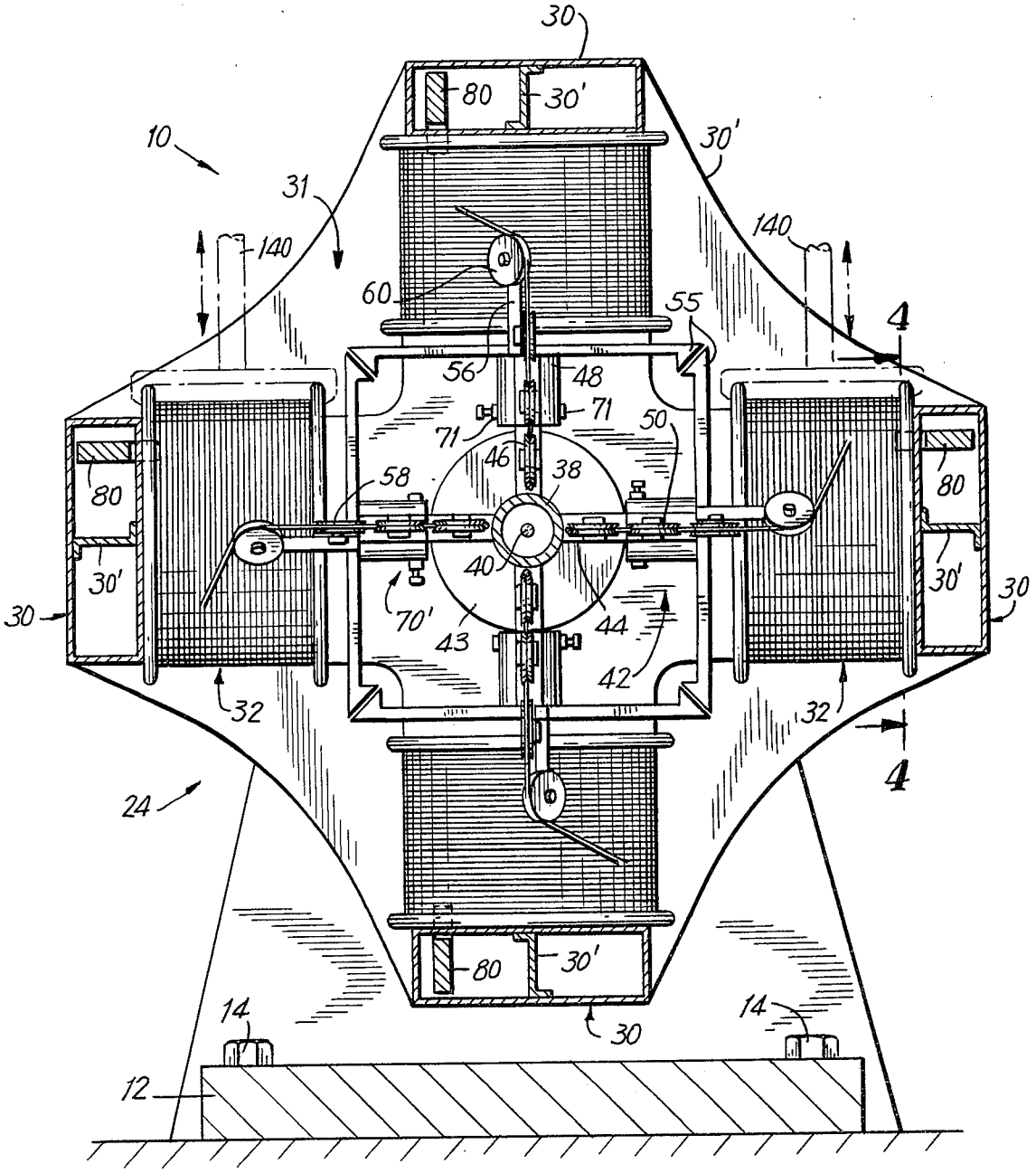
FIG. 2 is a cross-sectional view of the strander shown in FIG. 1, taken along line 2—2, and further showing in dashed outline the manner in which the bobbins are gripped during loading and unloading.

Referring now specifically to the drawings, in which identical or similar parts are designated by the same reference numerals throughout, and first referring to FIGS. 1 and 2, a high speed cage fly-off strander in accordance with the present invention is generally designated by the reference numeral 10.

The strander 10 includes a main frame base 12 which is secured to the floor or surface on which the machine is mounted by any conventional means, such as bolts 14.

The strander also includes front and rear bearing stands 16, 18 respectively which support the main or primary bearings 20, 22 which rotatably carry a cage or frame, generally identified by the reference numeral 24, for rotation about the machine or strander axis defined by the bearings 20 and 22.

The cage or frame 24 includes a frame front wall 26 and a front plate 27 mounted thereon, and a frame rear wall 28 and a rear plate 29 as shown. The end frame walls and plates are mounted for rotation about the bearings 20, 22 by means of any conventional drive, which is not shown.

Extending between the frame front and rear walls 26, 28 are four support portions or frame support members 30 which are spaced from and generally parallel to the axis of rotation of the strander, the support portions 30 being mounted on the frame end walls for rotation about the axis of rotation. The frame support members 30 may be fabricated in any suitable manner, for example, from steel plate and may be internally reinforced by use of I-beams or other reinforcing members as suggested, for example, in FIG. 2. The frame support members 30 are advantageously welded to the frame and walls 26, 28 so as to form an integral rigid assembly. For reasons which will become more apparent hereafter, the frame support members 30 must be sufficiently strong to withstand the maximum anticipated centrifugal forces, which can be substantial, during rotation of the frame 24. The dimensions of the frame support members 30 as well as any additional reinforcements thereof such as partitions or tying members 30' are, therefore, a function of the total weight of all the bobbins mounted on the support members as well as the maximum design speed of the cage or frame 24.

As viewed in FIG. 2, it would be evident that by angularly displacing the frame support members 30 about the axis of rotation of the strander, there are provided a plurality of access openings 31 between adjacent support members 30 which can be used to load and unload the bobbins from the machine as will be more fully described hereafter.

Again referring to FIG. 1, there is shown mounted on each frame support member 30 a plurality of bobbins 32 which are arranged in rows along the individual or respective support members generally in a direction parallel to the axis of the strander. Each bobbin is shown to have a flange 32*a* which abuts against a respective frame support member 30 and an opposing flange 32*b* which is radially inwardly spaced towards the axis of the machine. For reasons which will become evident, the present invention can also be used in conjunction with other wire-carrying devices which use inner flanges 32*b* which are smaller in diameter than the outer flanges 32*a*, or which totally eliminate the inner flanges.

The bobbins 32 are selectively releasably secured to the frame support members as will be more fully described below and do not rotate about their individual axes as with conventional stranders.

The bobbins 32 are fixed or secured to the frame support members 30 in a position displaced from the axis of rotation of the machine and with the longitudinal axes of the bobbins oriented generally radially at an angle substantially normal with respect to the axis, and preferably at 90° to the axis.

The bobbins 32 are secured to the frame support members 30 by means of fixed support members and movable pawls as will be more fully described in connection with FIG. 4.

Referring to FIGS. 1 and 2, the strander 10 has a central shaft 38 which is advantageously hollow and has a central opening along the axis of rotation of the cage or frame 24 and is aligned with similar through openings in the bearings 20 and 22 to permit passage along the axis of the strander of a core wire 40 onto which the wires or leads which are taken off the bobbins 32 may be wound.

Mounted for rotation about the axis of the strander is a low inertia balanced fly-off or take-off arm or guide 42 associated with each bobbin 32. For example, the guides 42 may be mounted on an annular plate 43 or secured to the shaft 38 directly for rotation therewith with rotation of the cage or frame 24. The guides or wire payout means 42 guide the wires 32*c* on the bobbins in a generally radially inward direction around the radially innermost end or flange 32*b* of the bobbin, as shown, and then to a point proximate to the shaft 38 at a point which is substantially coincident with the longitudinal axes of the respective bobbins 32. Subsequently, the wire 32*c* is advanced in a direction generally parallel to the shaft 38. With this arrangement, fly-off takes place under the action of external pulling forces acting on the wires, for example, by using a conventional capstan drive which pulls the stranded wire 40' through the stranding machine.

The fly-off or take-off arm 42 can best be described with reference to FIGS. 1 and 3. Connected to the annular plate 43 is a hollow shaft 44 on which there is mounted a pulley wheel 46 which is fixed with relation to the plate 43 and rotates about the axis of the shaft 38 with rotation of the cage or frame 24. Mounted for rotation on the shaft 44 about an axis substantially normal to the axis of rotation of the strander and substantially coincident with the longitudinal axis of a respective bobbin 32 is a fly-off assembly 48.

Figure 3:
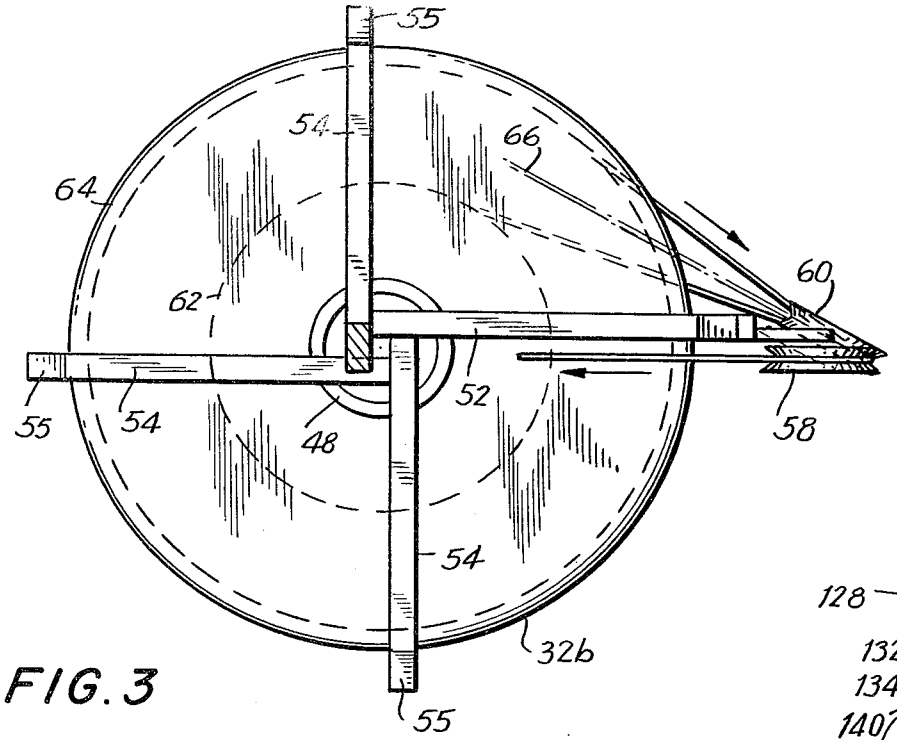
FIG. 3 is a cross-sectional view of the strander shown in FIG. 1, taken along line 3—3, to show some of the details of the fly-off or take-off arm or guide.

Mounted on the fly-off assembly 48, as best shown in FIGS. 1–3, is a fly-off arm 52 and a plurality of balancing arms 54 which, in the presently preferred embodiment are arranged at right angles to each other as shown. While more than four cooperating arms can be used, it has been found that at least four arms are required to provide balancing. Weights 55 may be provided at the ends of the balancing arms 54 which are selected to optimize balancing and assure smooth rotation and operation of the guide 42. The balancing arms 54 should be approximately the same length as the fly-off arm 52 to compensate for any preferential movements of the guide 42 during rotation.

If there is any possible interference of the arms on adjacent fly-off guides 42, the weights 55 may be suitably shaped as triangular wedges as shown in FIGS. 1 and 2 to assure clearance between the balancing arms in the worst condition when the balancing arms are in a common plane and adjacent to each other. Of course, during the actual operation of the machine, the fly-off and balancing arms 52, 54 will be randomly disposed about the respective individual axes of the bobbins so that interference would normally be avoided in most instances.

The length of the fly-off arm 52 is selected to be greater than the maximum radius of bobbin contemplated to be used with the strander. In this manner, a supporting bracket 56 projects radially outwardly from the fly-off arm 52 to an intermediate point along the bobbin and carries two radially spaced pulley wheels 58, 60 which simultaneously, together with the pulley 50, rotate about the axis of a respective bobbin 32 and shaft 44 as a wire 32*c* is caused to fly off a bobbin.

Referring to FIG. 3, there is shown in dashed outline the barrel 62 of the bobbin, the diameter of the barrel also corresponding to the diameter of the wire being drawn off at the time when the bobbin is substantially empty. The dashed circular line 64 corresponds to the diameter of the wire roll when the bobbin is full. The pulley wheel 60 is positioned approximately midway between the flanges 32*a* and 32*b* and is oriented as best shown in FIG. 3 to accept wire from the bobbin when the same is either full or almost empty. To minimize the possibility of wire escaping or leaving the groove of the pulley wheel 60, the same is advantageously oriented along a line coinciding with the median position 66 of the wire which is a position midway between the bobbin being full and empty. If desired, the pulley 60 can be slightly moved to one side or the other side of the median 66 to still further minimize escape of the wire from the pulley wheel 60 when the wire is taken from one side of the median 66. In that case, however, the likelihood of separation becomes greater when wire is drawn from the opposite side of the median 66. To prevent such separation, however, a suitable guard plate or stop member adjacent to the pulley wheel 60 may be provided to avoid escape of the wire.

Since the fly-off assembly 48 is rotatably mounted on the shaft 44 by means, for example, of a bearing, there is a minimum or inherent amount of friction during rotation of the take-off arm or guide 42. This minimum friction can, of course, be increased by a suitable brake, to be described, to assure proper tensioning and controlled fly-off of the wire from the bobbins 32.

The fly-off or take-off arm or guide 42, then, serves to initially receive the wire 32*c* on the pulley wheel 60, the pulley wheels 58 and 60 being arranged relative to each other to cause the wire to advance in a direction generally radially inwardly to a point on the other side of the fly-off and balancing arm arrangement so that the wire can be brought to a point, by means of pulley wheel 50, which is substantially coincident with the longitudinal axis of the bobbin 32 and the shaft 44. The wire 32*c* advances along the axis of the shaft 44 and its direction of movement is changed by 90° by the pulley wheel 46 mounted on the shaft 44 so as to bring the advancing wire to a point proximate to the shaft 38 in a direction parallel to the axis of the strander. The wires from all the bobbins 32 are caused to fly-off in the same manner and all the wires are brought to points proximate to and parallel to the shaft 38. All the wires about the shaft 38 are pulled out of the end of the strander and wound about the core wire 40'.

While the friction of the bearing in the fly-off assembly 48 may be sufficient for some purposes, it may be desirable in some cases to increase the tension on the wire during fly-off. This can be accomplished by simply providing a suitable braking mechanism which applies an adjustable braking force on the housing of the fly-off assembly 48. For example, as shown in FIG. 2, there is shown a clamping arrangement which is fixedly mounted on the support plate 43 and is provided with a screw adjustment for applying a variable pressure on a pair of clamping bars 71 which may include suitable pads. In this manner, a continuously adjustable braking force can be applied to the housing of the fly-off assembly 48 and thus the tension applied to the wire during fly-off can be controlled.

An important feature of the present invention is that the bobbins 32 are fixedly mounted to the frame support members 30 to that they do not rotate about their axes during the operation of the strander. In this connection, any suitable securing means may be provided on the support members or support portions 30 for securing the bobbins 32 thereto. Referring particularly to FIG. 4, the securing means is shown to include a plurality of support members 72, 74, 76 and 78 which are configurated and arranged to selectively engage the flange 32*a* of the bobbin which is in abutment against the respective support member 30 to release that flange in a direction substantially transversely to both the support member 30 itself as well as to a direction radial with respect to the axis of the strander.

Figure 4:
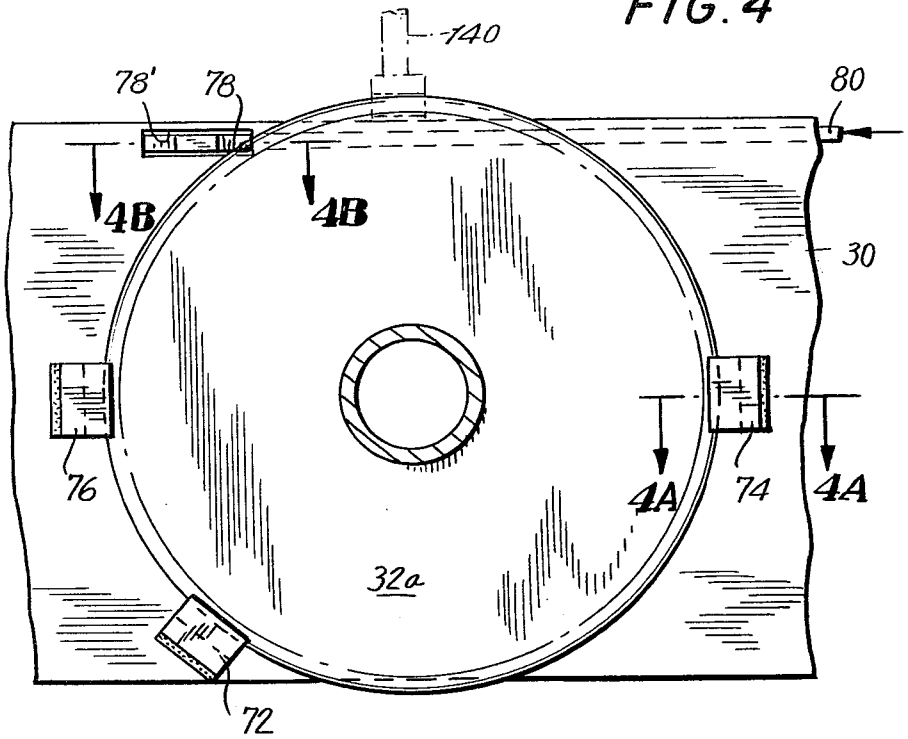
FIG. 4 is a cross-sectional view of the strander shown in FIG. 2, taken along line 4—4, to show some of the details of the securing members for holding the bobbins in place on the strander cage or frame during the loading and unloading operation.
Figure 4A:
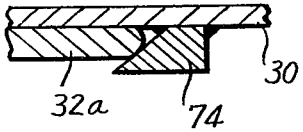
FIGS. 4A and 4B are sectional views taken in FIG. 4 along lines 4A—4A and 4B—4B respectively.

With the support member 30 positioned as shown in FIG. 4, two of the support members 74 and 76 are advantageously positioned along a substantially horizontally directed line. An additional support member 72 is provided which is disposed below and generally more proximate to the fixed support member 76. The support members 72, 74 and 76 may be fixed permamently or by bolts to the support member 30 and movable along slots to accommodate the periphery of the flange 32*a*, as shown in FIG. 4A, as well as bobbins having different flange diameters.

The support members 72, 74, 76 generally define a circle having a diameter which is somewhat greater than the diameter of the flange 32*a*, so that when the bobbin is held as shown in FIG. 4, there is some clearance to permit some play of the bobbin between the supports. The fixed support members 74 and 76, in essence, initially guide the flange 32*a* to facilitate mounting of the flange 32*a* and removal of the flange from the support member 30. When the bobbin is fully lowered to the position shown in FIG. 4, it rests on the lower fixed support 72 and on the lateral support 74, the other lateral support 76 functioning primarily as a guide during insertion.

At least one of the support members is in the nature of a pawl 78 which is movable between locking and releasing positions so as to lock and release the bobbin during the loading and unloading operation. The mounting or securing means shown in FIG. 4 for one bobbin is repeated for each bobbin along the length of the support member. One advantageous feature of the invention is that it is possible to use a locking or actuating mechanism for simultaneously moving the movable pawls 78 for all the bobbins mounted on a common support portion or support member 30 to thereby simultaneously release or lock the bobbins supported thereon and permit the simultaneous insertion or removal of an entire row of bobbins on a support portion 30.

Figure 4B:
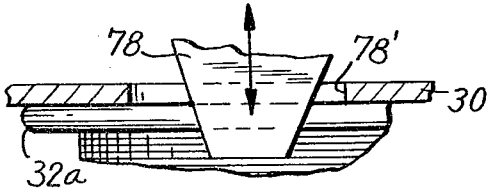

The movable pawl 78, in the locking position thereof, advances in the direction of the flange 32*a* and urges the flange against the fixed support members 72 and 74, forming a three point contact system, wherein the flange 32*a* is fixedly secured at three points uniformly about the periphery thereof. With this arrangement, wherein the support members are distributed about the periphery of the flange 32*a*, only the movable pawl 78 can be positioned in the path of removal or insertion of the bobbin into the strander. Referring to FIGS. 4 and 4B, the pawl 78 may be retracted into a slot 78' of the frame support member 30 during loading and unloading so as not to interfere with the free movements of the bobbin.

Figure 5:
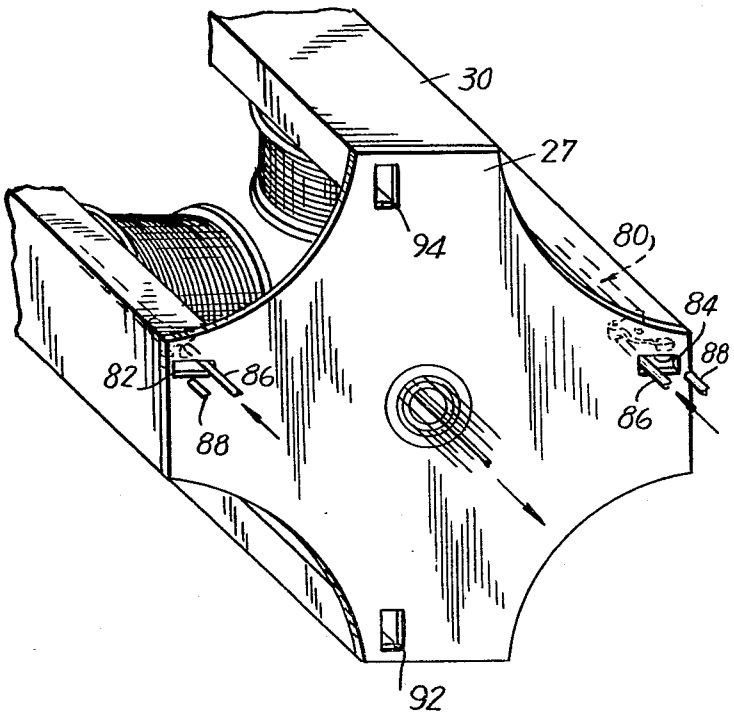
FIG. 5 is a fragmented perspective view of the strander shown in FIG. 1, as viewed from the front end of the strander with the front bearing stand removed to show the openings in the front plate which provide access to the locking mechanism to permit simplified locking and unlocking of one row of bobbins or two diametrically opposite rows of bobbins.

The specific locking mechanism 80 used is not critical for purposes of the present invention. However, it is desirable that single actuation thereof automatically moves all the pawls 78 on a single support member 30 to the locking or releasing position. Referring to FIG. 5, there is shown one approach to obtain such simultaneous actuation. Formed in the front plate 27 is a pair of rectangular slots or openings 82, 84 each associated and in registry with another frame support member 30. The cage or frame 24 is rotated to a loading position as shown in FIG. 5, where two diametrically opposing support members 30 are disposed in a generally horizontal plane and two other support member 30 in a vertical plane to position the openings 82 and 84 in alignment with a plurality of pistons 86, 88 mounted on the front bearing stand 16. The pistons 86, 88 may be actuated and moved through the openings 82 and 84 in the front plate 27 by suitable actuation of a reel locking cylinder actuator 90. With this arrangement, for example, insertion of the pistons 86 through the openings 82 and 84 actuates the locking mechanism 80 to move the pawls 78 from one position to another while insertion of the pistons 88 returns the pawls to their original position. The pistons 86 can, for example, be used to lock the pawls and the pistons 88 can be used to unlock the same. As noted, the specific arrangement of the locking mechanism 80 is not critical so long as it can positively lock the pawls 78 when moved by one of the pistons 86 or 88. Advantageously, however, the pawls are spring biased in their locking positions so as to prevent chattering during low speed operation of the strander. As a practical matter, however, the securing means including the support members 72, 74, 76 and 78 primarily come into play during loading and unloading and at very low rotational speeds of the strander. Once the angular velocity of the cage or frame 24 reaches its operational speed, the bobbins 32 are urged outwardly against the support members by reason of the centrifugal forces so that the frictional forces which develop between the flanges 32*a* and the support members 30 are more than sufficient to prevent relative movement therebetween. In this sense, unlike prior art stranders, the higher the speed of the strander, the more secure the bobbins and the less danger of accidental release of the bobbins.

Still referring to FIG. 5, once the bobbins have been inserted or mounted on two support members arranged in a horizontal plane and the corresponding pawls have been moved to the locking positions, the cage or frame 24 can be rotated 90° to position the openings 92 and 94 associated with the other two support members in alignment with the pistons 86 and 88. Again, the actuator 90 may be suitably energized to release or lock the bobbins in place as may be required. It will be evident from this discussion that the loading and unloading operation requires only two angular positions of the frame or cage 24 to lock and release all of the bobbins in the machine.

As will be more fully discussed below, an important feature of the present invention, when the bobbins are mounted in pairs which are arranged on diametrically opposite sides of the axis of rotation, is that the cage is always balanced. No preferential movements are exhibited as long as bobbins are mounted on all of the frame support members 30 or when diametrically opposite rows of bobbins are simultaneously removed. This, therefore, includes stranders which support two diametrically opposite pairs of rows, or which carry two, three or more pairs of diametrically opposite rows. Because the cage 28 is normally balanced, positioning the openings in the front plate 27 into alignment with the pistons 86, 88 can be achieved with a low torque indexing means of any conventional type. Such indexing means can utilize electronic sensing means which automatically stops the cage or frame 24 precisely at the required alignment positions for loading and unloading of the bobbins and locking and releasing the pawls 78.

Figure 9:
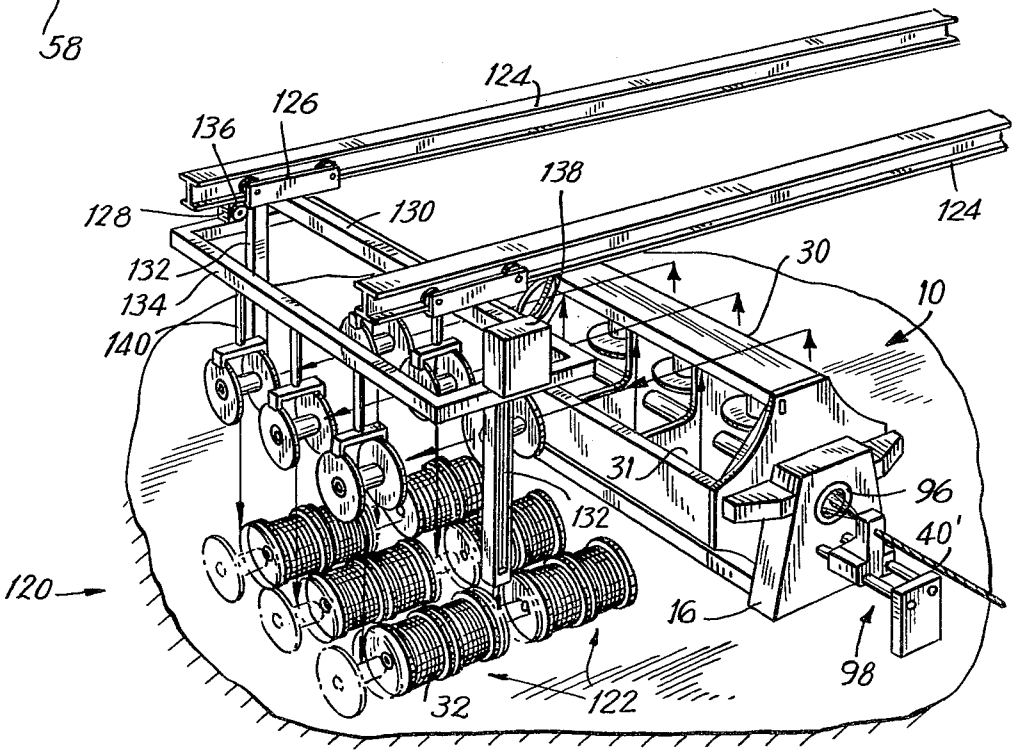
FIG. 9 is a perspective view of the strander shown in FIGS. 1 and 2 together with a loading and unloading system in accordance with the present invention.

Referring particularly to FIG. 9, the front bearing stand 16 includes a conventional lay plate 96 for properly positioning the individual strands which have been removed from the bobbins for entry into a die which is mounted on a die-positioning mechanism 98. Upstream of the die positioning mechanism 98 there is typically provided a capstan drive which applies pulling forces on the stranded wire 40' and, therefore, on the individual strands to cause the same to fly off the bobbins 32 with attendant rotation of the fly-off arms or guides 42.

Referring to FIG. 1, a brake disc 102 is rigidly secured to the cage 24 by means of spacer mounts 104 as shown. A conventional brake disc assembly 106 receives a portion of the periphery of the brake disc 102 for selectively braking the disc and, therefore, the cage 24 in a conventional manner.

While the grame support member 30 in the embodiment shown in FIGS. 1 and 2 are arranged in pairs, with each pair or frame members being disposed on diametrically opposite sides of the strander axis, with the longitudinal axes of the corresponding bobbins passing through the strander axis, another embodiment 108 of the strander is shown in FIG. 6. Here, the support members 110 and 112 are each offset on opposite sides of the strander axis, as viewed in FIG. 6, to cause the axis of each of the respective bobbins mounted on the support members to be offset from the axis of rotation of the strander. With the embodiment of FIGS. 1 and 2, the fly-off devices or guides 42 are mounted radially outwardly of the shaft 38, while the guides 42 and bobbins are moved radially inwardly to the sides of the shaft in FIG. 6. Besides resulting in a more compact strander, the embodiment 108 of FIG. 6 lowers the centrifugal forces acting on the bobbins, the wire and the take-off guides 42 with attendant decreases in frictional forces between the fixed shafts 44 and the fly-off assemblies 48. The reduction of centrifugal forces in this manner results in reduced tensions being applied to the wires being flown off. Accordingly, the embodiment shown in FIG. 6 can be used in connection with finer wires or, for the same gauge wire, higher rotational speeds can be used. However, the arrangement shown in FIG. 6 is limited to only one pair of opposing bobbins in a plane, as opposed to the four bobbins in a plane possible with the originally disclosed embodiment.

Referring to FIG. 7, still another embodiment 114 of the invention is shown, wherein three frame support members are provided and angularly spaced from each other about the axis of the shaft by 120°. With this embodiment, only three bobbins are mounted in a common plane transverse to the axis of the strander. Otherwise, the operation of the stranders shown in FIGS. 6 and 7 is identical to that of the strander 10 shown in FIGS. 1 and 2. While the stranders 10 and 108 have the above described advantage that they are always balanced in any normal condition of loading and unloading, this is not the case for the strander 114 shown in FIG. 7. Here, only one row of bobbins can be removed from one of the frame support members 30, this instantaneously unbalancing the entire cage until such time that the other two rows of bobbins have also been removed. The strander 114, therefore, is only balanced when it is fully loaded or unloaded. Positioning the strander 114 into the loading and unloading positions for each support member 30 requires a higher torque drive than that required for the other described stranders which remain balanced.

In FIG. 8, there is shown a bobbin having a slightly modified winding cross section. Instead of having a uniform winding diameter along the longitudinal axis thereof the winding diameter is maximum at the flange 32*a* and minimum at the flange 32*b*, having a generally uniformly changing diameter therebetween. While the taper on the winding is shown somewhat exaggerated to facilitate illustration, the difference in diameters can, for example, be typically one inch on a fourteen to fifteen inch height bobbin. The purpose of such taper is to prevent shifting of the turns in response to centrifugal forces acting on the wire during rotation of the cage about its axis. With the uniformly wound bobbins, there is sometimes a tendency, particularly with low gauge wire, for individual turns to be thrown outwardly at high rotational speeds, especially when the bobbins are loosely wound. Such riding or shifting of the turns may tangle the wires and cause breakage during take-off or fly-off by the guide 42. By providing a slight taper as shown in FIG. 8, with the larger diameter positioned at the flange 32*a* which is mounted on the frame support member 30, or at the radially outermost position, it has been observed that such undesired shifting of turns is avoided.

Also shown in FIG. 8 is a smooth ring 116 mounted on the innermost flange 32*b*. The smooth ring 116 may be optionally used in place of the fly-off arms or guides 42, particularly when the wires on the bobbins are to be flown off at low tension. In such cases, even the relatively small tension resulting from the inherent friction in the fly-off arms or guides may be too large. The wire 32*c*, rides along the outer smooth periphery of the ring 116 and can then be received, for example, directly in an axial opening of the shaft 44 and removed along the shaft 38 by means of the pulleys 46 proximate to that shaft.

In some instances, the stranders of the present invention can be used in conjunction with bobbins which do not have an innermost flange 32*b*, but only an outermost flange 32*a* which is used to secure the bobbin as above described. In such cases, however, special handling of the bobbins is required.

As suggested, an important feature of the present invention is that it permits greatly simplified and more efficient loading and unloading of bobbins. Referring to FIG. 9, the strander 10 is illustrated in conjunction with a loading-unloading system generally designated by the reference numeral 120. The system includes horizontal I-beams 124 which are mounted on vertical support columns (not shown). Mounted for movement along the beams 124 are trolley assemblies 126 which may be controlled by a transverse drive 128 to move along the beams between positions over the strander 10 and a bobbin station 122.

Fixed to the trolley assemblies 126 is a horizontal support beam 130 and two vertical lifting racks 132. A gripper support frame 134 is movably mounted along the vertical direction by means of lifting rack and pinion assemblies 136 which are controlled by a lifting drive 138. Actuating of the lifting drive is effective to raise or lower the support frame 134 along the lifting racks 132.

Mounted on the support frame 134 are a plurality of reel grippers 140. The grippers 140 are provided on the frame 134 on each side of the support beam 130 as shown, the spacing between the grippers 140 corresponding to the spacing of the bobbins when mounted in the strander 10.

As should be clear, appropriate actuation of the transverse drive 128 and lifting drive 138 can lower the reel grippers 140 at the bobbin station 122 or at the strander 10. The construction of the reel grippers is not critical and may, for example, be pneumatically or hydraulically actuated to grip a pair of flanges of the bobbin as suggested in FIG. 2. For this reason, the peripheral edges of the bobbins extend beyond the frame supporting members so that they may be engaged by the grippers 140 and removed from the strander once the movable pawls have been moved to their unlocking or retracted positions. With this arrangement, replacing four rows of empty bobbins with full ones can take as little as ten minutes or less. In addition to such reduced loading and unloading times, however, the overall production and efficiency of the machine in accordance with the present invention is enhanced as a result of its ability to accept larger bobbins which, therefore, permits continuous running of the machine with little interruption.

The further advantage of the present invention is the ability of the strander to handle wire at lower tension than conventional machines. The strander of the present invention allows the user to operate the machine at a higher speed with the same size wire or at the same speed with much larger packages and therefore higher productivity. This is achieved because contrary to the present state of the art the braking system on the fly-off arm is independent from the bobbin on which the wire is wound. The tension on the wire is constant throughout the entire production run and can be set at lower values because the fly-off arm is positioned very close to the axis of the strander and therefore is subject to a lower amount of centrifugal force. The strander of the present invention allows productivity gains of the order of four to ten times the production rates achieved with state of the art machines.

It is to be understood that the foregoing description of the various embodiments illustrated herein is exemplary and various modifications to the embodiments shown herein may be made without departing from the spirit and scope of the invention.

What is claimed is:

1. A strander comprising a longitudinal shaft defining the machine axis of the strander and adapted to advance a core wire along the length thereof; a support portion spaced from and generally parallel to said shaft and mounted for rotation about said axis; securing means on said support portion for securing at least one wire-carrying bobbin to said support portion in a position displaced from said shaft and with the longitudinal axis of said at least one bobbin oriented generally radially at an angle substantially normal with respect to said shaft axis; and wire payout means for guiding the wire paid off from said at least one bobbin in a generally radially inward direction around the radially innermost end thereof, thence to a point proximate to said shaft which is substantially coincident with the longitudinal axis of said at least one bobbin, without requiring the bobbins to rotate about their individual axes, and thence in a direction generally parallel to said shaft, fly-off taking place under the action of external pulling forces acting on the wires, thus enabling the wires which are paid off the bobbins to be brought to an end of said shaft and wound about the core wire.

2. A strander as defined in claim 1, wherein said shaft is hollow and adapted to advance the core wire through the center thereof.

3. A strander as defined in claim 1, wherein a plurality of support portions are provided which are angularly spaced from each other about said axis and rigidly joined to one another to form a rotating cage frame and access openings for said bobbins between each two adjacent support portions.

4. A strander as defined in claim 1, wherein a plurality of support portions are provided which are angularly spaced from each other about said axis, each support portion being provided with securing means for at least one bobbin.

5. A strander as defined in claim 4, wherein said support portions are uniformly angularly spaced from each other about said axis.

6. A strander as defined in claim 1, wherein a plurality of securing means are provided on said support portion for securing a plurality or row of wire-carrying bobbins along the length of said support portion generally in a direction parallel to the axis of the strander.

7. A strander as defined in claim 6, wherein said plurality of securing means are uniformly spaced from each other.

8. A strander as defined in claim 1, wherein a plurality of support portions are provided which are angularly spaced from each other about said axis, and wherein said securing means on said support portions are arranged to secure at least two bobbins on different support portions in a common plane substantially normal to the axis of the strander.

9. A strander as defined in claim 1, wherein said support portion and securing means are arranged to cause the axis of said at least one bobbin to pass through the axis of rotation of the strander.

10. A strander as defined in claim 1, wherein said support portion and securing means are arranged to cause the axis of said at least one bobbin to be offset from the axis of rotation of the strander.

11. A strander as defined in claim 1, further comprising tensioning and guide means in the nature of a device mounted for rotation on said shaft about an axis substantially coaxial with the longitudinal axis of said at least one bobbin, whereby flying wire off the bobbin causes said device to rotate about the axis thereof.

12. A strander as defined in claim 11, wherein said device comprises a generally elongate arm having at least a portion thereof extending to a position generally intermediate the axial ends of the stationary bobbin, and further comprising a plurality of pulley wheels spaced from each other along said elongate arm to guide the wire from the fly-off position to a position generally parallel to the axis of said shaft.

13. A strander as defined in claim 11, further comprising adjustable braking means for applying a controllable braking force acting on said device, whereby the tension and the rate at which the wire is flown off the bobbin can be adjustably controlled.

14. A strander as defined in claim 1, in combination with a loading system wherein at least one pair of two support portions are provided which are disposed at substantially diametrically opposite sides of the strander axis, each support portion being adapted to releasably support at least one wire-carrying bobbin in a position displaced from the axis of rotation and with the axis of the bobbin oriented generally radially at an angle substantially normal to the axis of the strander, the loading system comprising positioning means for rotating a pair of support portions to a loading and unloading position; locking and releasing means for selectively locking or releasing the bobbins on said pair of support portions while the same are in the loading and unloading position; and bobbin gripping means for substantially sumultaneously removing empty bobbins from both said support portions of said pair and subsequently substantially simultaneously inserting full bobbins onto both said support portions of said pair, whereby the strander is always balanced during the entire loading and unloading operation.

15. A strander as defined in claim 14, wherein said positioning means comprises a low torque indexing means.

16. A bobbin loading system for a strander having an axis of rotation and at least one pair of two support portions spaced from and generally parallel to the strander axis, such support portions being disposed at diametrically opposite sides of the strander axis, each support portion being adapted to releasably support at least one wire-carrying bobbin in a position displaced from the axis of rotation and with the axis of the bobbin oriented generally radially at an angle substantially normal to the axis of the strander, the loading system comprising positioning means for rotating a pair of support portions to a loading and unloading position; locking and releasing means for selectively locking or releasing the bobbins on said pair of support portions while the same are in the loading and unloading position; and bobbin gripping means for substantially simultaneously removing empty bobbins from both said support portions of said pair and subsequently substantially simultaneously inserting full bobbins onto both said support portions of said pair, whereby the strander is always balanced during the entire loading and unloading operation.

17. A strander as defined in claim 1, wherein said securing means comprises a plurality of support members configurated and arranged to selectively engage a flange of a bobbin which is in abutment against a respective support portion and to release said flange in a direction substantially transversely both to said support portion and to a direction radial with respect to the axis of the strander.

18. A strander as defined in claim 17, wherein at least one of said support members in the nature of a pawl movable between locking and releasing positions to place said securing means in said locking and releasing conditions respectively.

19. A strander as defined in claim 18, wherein a plurality of securing means are spaced along the length of said support portion each having a movable pawl, and actuation means for simultaneously moving said movable pawls of all said securing means on said support portion to thereby simultaneously release or lock the bobbins supported thereon and thereby permit the simultaneous insertion or removal of an entire row of bobbins on a support portion.

20. A strander as defined in claim 18, wherein said support members are distributed about the periphery of the abutting flange of the bobbin being supported, only said movable pawl of each securing means being positioned in the path of removal or insertion of the bobbins into the strander, said movable pawls being retractable into said support portions during loading and unloading so as not to interfere with the free movements of the bobbin.

* * * * *